US005850953A

United States Patent [19]

Dallas, Jr.

[11] Patent Number: 5,850,953

[45] Date of Patent: Dec. 22, 1998

[54] DRIP-FREE DISPENSING STRUCTURE WITH COLLECTING RESERVOIR

[75] Inventor: Milton R. Dallas, Jr., East Troy, Wis.

[73] Assignee: AptarGroup, Inc., Crystal Lake, Ill.

[21] Appl. No.: 789,756

[22] Filed: Jan. 28, 1997

[51] Int. Cl.[6] ..... B65D 5/72

[52] U.S. Cl. ..... 222/571; 222/109; 222/111; 222/568

[58] Field of Search ..... 222/109, 111, 222/568, 571

[56] References Cited

U.S. PATENT DOCUMENTS

| | | | |
|---|---|---|---|
| 120,387 | 10/1871 | Lang et al. . | |
| 175,811 | 4/1876 | Wright . | |
| 218,416 | 8/1879 | Wright . | |
| D. 292,489 | 10/1987 | Kowollik et al. . | |
| D. 292,490 | 10/1987 | Kowollik et al. . | |
| D. 321,317 | 11/1991 | Sherman et al. . | |
| 573,759 | 12/1896 | Brown . | |
| 677,850 | 7/1901 | Baron et al. . | |
| 2,763,403 | 9/1956 | Livingstone . | |
| 2,851,196 | 9/1958 | Livingstone . | |
| 3,961,732 | 6/1976 | Roberts . | |
| 4,047,648 | 9/1977 | Croyle . | |
| 4,078,700 | 3/1978 | Hidding | 222/109 |
| 4,128,189 | 12/1978 | Baxter . | |
| 4,264,022 | 4/1981 | Pernë . | |
| 4,298,145 | 11/1981 | Iida | 222/478 |
| 4,531,657 | 7/1985 | Saito et al. . | |
| 4,550,862 | 11/1985 | Barker et al. | 222/109 |
| 4,635,823 | 1/1987 | Stull | 222/108 |
| 4,664,295 | 5/1987 | Iida | 222/109 |
| 4,696,416 | 9/1987 | Muckenfuhs et al. . | |
| 4,706,829 | 11/1987 | Li . | |
| 4,890,768 | 1/1990 | Robinson . | |
| 4,890,770 | 1/1990 | Haga et al. | 222/109 |
| 4,974,749 | 12/1990 | Mon | 222/111 |
| 4,989,757 | 2/1991 | Krall . | |
| 5,108,009 | 4/1992 | Davidson et al. | 222/109 |
| 5,141,138 | 8/1992 | Odet et al. . | |
| 5,234,130 | 8/1993 | Benioff et al. . | |
| 5,251,788 | 10/1993 | Moore | 222/111 |
| 5,431,306 | 7/1995 | Reid . | |
| 5,509,579 | 4/1996 | Robbins . | |
| 5,566,862 | 10/1996 | Haffner et al. | 222/111 |

*Primary Examiner*—David J. Walczak
*Assistant Examiner*—Timothy L. Maust
*Attorney, Agent, or Firm*—Rockey, Milnamow & Katz, Ltd.

[57] ABSTRACT

A drip-free dispensing structure is provided with a body for extending from a container around an opening. The body has a crescent-shaped inner spout. An outer collar is spaced outwardly of the inner spout. A drain-back trough is defined between the inner spout and outer collar. The trough runs from a high point at the front of the structure to a low point on either side and empties into a reservoir defined at the rear of the structure. A notch in the wall of the inner spout permits the collected fluid in the reservoir to flow back into the container when the container is subsequently tilted forwardly to pour liquid from the container.

3 Claims, 2 Drawing Sheets

DRIP-FREE DISPENSING STRUCTURE WITH COLLECTING RESERVOIR

TECHNICAL FIELD

This invention relates to a system for dispensing a product from a container. The invention is more particularly related to a system incorporating a dispensing structure which eliminates or substantially minimizes dripping of liquid along the outside of the structure and container during and after pouring of liquid from the container. The invention is particularly suitable for use with containers having small openings and/or necks with thick walls.

BACKGROUND OF THE INVENTION AND TECHNICAL PROBLEMS POSED BY THE PRIOR ART

A variety of packages that include dispensing systems on containers have been developed for household products such as liquid laundry detergents and other materials. Such containers typically have a neck defining an open upper end on which is mounted the dispensing closure. The dispensing closure for these kinds of containers typically has a pour spout which is covered with a removable lid. Some types of these dispensing closures include features which minimize dripping during and after pouring of the liquid from the container. See, for example, the closure designs disclosed in the U.S. Pat. Nos. 5,509,579, 5,431,306, and 4,890,768.

While such types of drip-reducing dispensing closures may function generally satisfactorily in applications for which they are designed, it would be desirable to provide an improved dispensing structure for eliminating or minimizing dripping of liquid along the exterior of the dispensing structure and/or container during and after pouring of the liquid from the container. In particular, such an improved dispensing structure design should have the capability for accommodating the provision of a directional pour spout in those applications where that would be desirable.

Further, the improved dispensing structure should preferably function to eliminate or minimize exterior dripping even at very low pour rates. The improved dispensing structure should preferably also accommodate the use of a completely removable lid or hinged lid.

It would also be advantageous if such an improved dispensing structure could function through a wide range of pour tilting angles and through a wide range of flow rates to provide a relatively smooth discharge stream during pouring of the liquid contents from the container. In this respect, it would be desirable if "glugging" (i.e., uneven or pulsating flow as air enters the container) could be eliminated or substantially minimized throughout such an operational range.

In addition, the improved dispensing structure should function well with a wide range of liquids, including high viscosity liquids and low viscosity liquids. It would also be beneficial if such an improved closure could function well with liquids having different surface tension characteristics.

Additionally, it would be desirable to provide such an improved dispensing structure with the capability for returning liquid from the spout area back into the container. Some containers may have relatively small openings and/or thick walls around the openings. This can significantly limit the space available in dispensing structure for returning the liquid into the container. Thus, it would be advantageous to provide an improved dispensing structure that could readily accommodate the return of liquid into such containers.

It would also be beneficial if such an improved dispensing structure could readily accommodate its manufacture from a variety of different materials.

Further, it would be desirable if such an improved dispensing structure could be provided with a design that would accommodate efficient, high quality, large volume manufacturing techniques with a reduced product reject rate. Preferably, the improved dispensing structure should also accommodate high speed manufacturing techniques that produce products having consistent operating characteristics unit-to-unit with high reliability.

The present invention provides an improved dispensing structure which can accommodate designs having the above-discussed benefits and features.

SUMMARY OF THE INVENTION

According to one aspect of the present invention, a dispensing structure is provided for a container of liquid so as to eliminate or minimize dripping of the liquid along the exterior of the structure and/or container during and after pouring of the liquid. The structure includes a body for extending from a container around an opening. The body has an inner spout which defines a notch.

In a preferred embodiment, the body inner spout has a first wall extending only partially around the opening between two lateral margins. The inner spout also has a retention wall adjacent the opening. The retention wall extends between the two lateral margins of the spout first wall. The retention wall also defines the notch. Preferably, the notch is open upwardly, although it may be bridged over by an upper part of the retention wall.

An outer collar is spaced outwardly of, and extends continuously around, the inner spout and opening.

The dispensing structure also includes a recessed floor. The floor is located between part of the inner spout and the outer collar, and the notch is located between the body opening and the recessed floor. Preferably, the recessed floor is spaced below the bottom of the notch.

A drain-back trough bottom extends between the outer collar and the inner spout. The trough bottom has a high point and two, spaced-apart low points which are each located adjacent, but at a higher elevation than, the recessed floor.

In a preferred embodiment, a reservoir is defined by (i) the retention wall, (ii) the outer collar, (iii) two, spaced-apart sidewalls each extending from one of the lateral margins to the outer collar, and (iv) a generally planar, horizontal surface defining the recessed floor.

When the dispensing structure is tipped to discharge liquid from the container, some liquid may run down the exterior side of the inner spout. Such liquid flows along the drain-back trough bottom into the reservoir where it can accumulate in a small pool when the container is tipped back up vertically. When the container is subsequently tipped again to pour additional liquid, the liquid that had accumulated in the reservoir flows through the notch and down the spout back into the container.

Because there is no drain-back aperture required in the floor or deck of the structure between the inner spout and the outer collar, the dispensing structure can accommodate a container having a relatively small opening and/or relatively thick neck wall.

In a preferred form of the invention, the dispensing structure is a closure which includes a lid which may be hinged to, or completely removable from, the body of the structure.

The dispensing structure of the present invention may be formed as a unitary part of the container. Alternatively, the dispensing structure may be formed as a separate piece which can be subsequently mounted to the container. Such a dispensing structure in the form of a closure can be designed for attachment to the top of the container by means of a threaded engagement or snap-on engagement.

According to another aspect of the invention, a dispensing structure includes a body for extending from a container around an opening. The body has an inner spout projecting above the opening. At least a portion of the height of the inner spout above the opening has a crescent-shaped, transverse cross section. The inner spout has (i) a first wall extending only partially around the opening between two lateral margins, and (ii) a retention wall adjacent the crescent-shaped opening. The retention wall extends between the two lateral margins of the spout first wall. The retention wall defines an upwardly open notch which does not extend all the way to the bottom of the retention wall.

The body has an outer collar spaced outwardly of, and extending continuously around, the inner spout and opening.

The body has a reservoir which is defined by (i) the retention wall, (ii) the outer collar, (iii) two, spaced-apart sidewalls each extending from one of the lateral margins of the outer collar, and (iv) a floor that is spaced below the bottom of the notch.

The body also includes a drain-back trough between the outer collar and the inner spout. The trough has an open end adjacent each lateral margin. The trough has a bottom with a high point and two spaced-apart, low points which are each located adjacent, but at a higher elevation than, the reservoir floor.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENT

Figure 1:
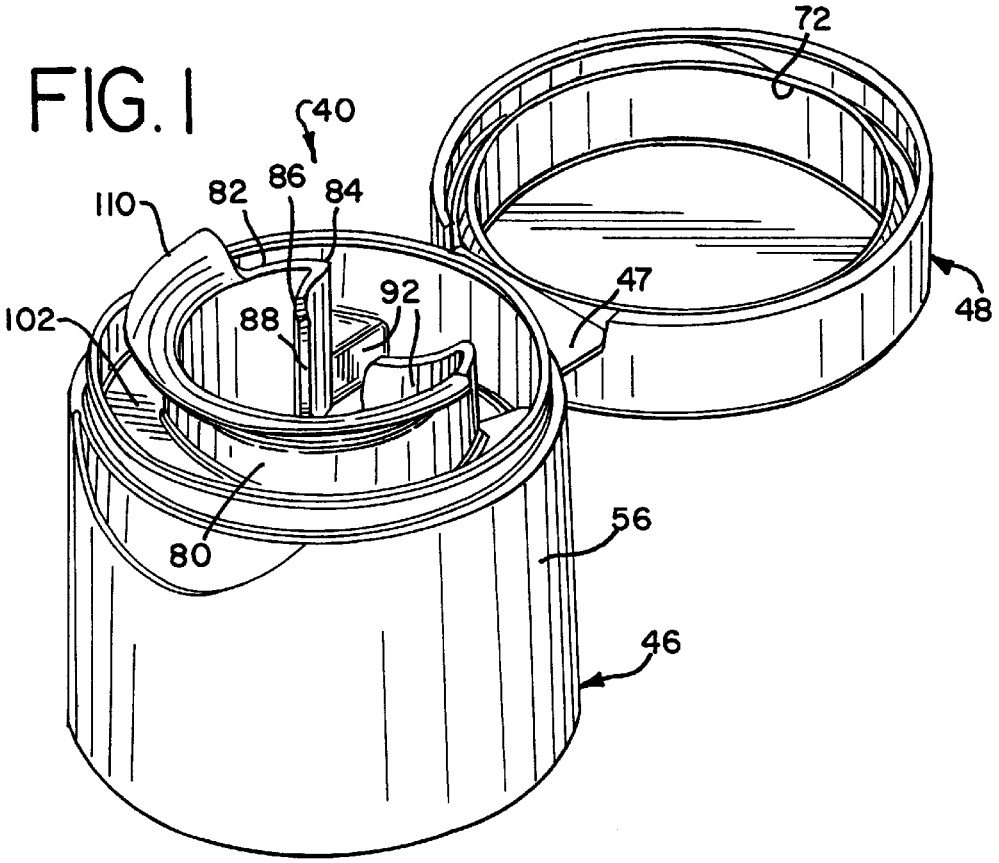
FIG. 1 is a front perspective view of a first embodiment of the dispensing structure of the present invention shown with the lid open.
Figure 2:
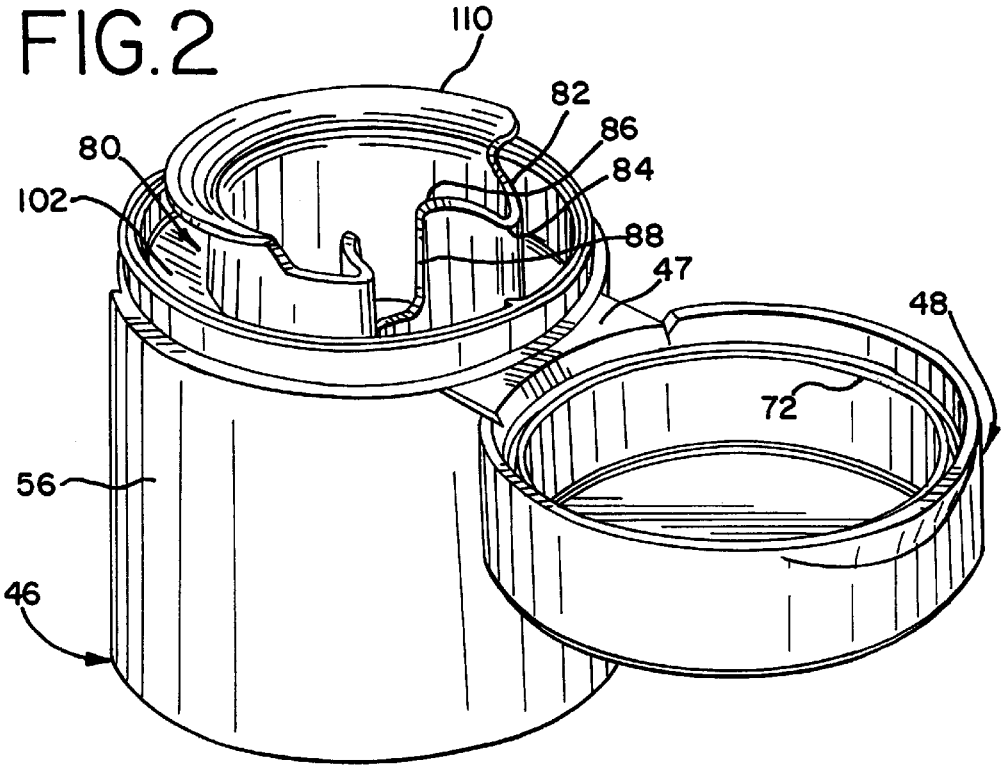
FIG. 2 is a rear perspective view of the open dispensing structure.

While this invention is susceptible of embodiments in many different forms, this specification and the accompanying drawings disclose only one specific form as an example of the invention. The invention is not intended to be limited to the embodiment so described, and the scope of the invention will be pointed out in the appended claims.

For ease of description, the dispensing structure of this invention is described in a typical upright position, and terms such as upper, lower, horizontal, etc., are used with reference to this position. It will be understood, however, that the structure may be manufactured and stored in orientations other than the one described.

A presently preferred embodiment of a dispensing structure of the present invention is illustrated in the figures and is designated generally therein by the reference numeral 40. The dispensing structure is provided in the form of a closure 40 which is adapted to be mounted on a container (not illustrated). The container typically has a conventional mouth or opening formed by a neck or other suitable structure. The neck typically has (but need not have) a circular cross-sectional configuration, and the body of the container may have another cross-sectional configuration, such as an oval cross-sectional shape, for example.

The container may typically be rigid or substantially rigid. Alternatively, the container may be a squeezable container having a flexible wall or walls which can be grasped by the user and compressed to increase the internal pressure within the container so as to squeeze the product out of the container through the closure when opened. The container wall typically has sufficient, inherent resiliency so that when the squeezing forces are removed, the container wall returns to its normal, unstressed shape. Such a structure may be preferred in some applications, but may not be necessary or preferred in other applications.

With reference to FIG. 1, the closure 40 includes a base or body 46 and preferably includes a lid 48 connected to the base or body 46 with a hinge 47. The lid 48 is adapted to be moved between (1) a closed position (not illustrated) in which the lid 48 is sealingly engaged with the closure body 46 to prevent dispensing of a liquid from the container to which the closure is mounted, and (2) the illustrated open position in which the lid 48 is disengaged from the closure body to permit dispensing of the liquid through the closure.

Preferably, the hinge 47 is a snap-action hinge formed integrally with the lid 48 and body 46 in a unitary structure. The illustrated snap-action hinge 47 is a conventional type described in U.S. Pat. No. 4,403,712. Other hinge structures may be employed, including a "floppy" living film hinge. However, it is preferable to employ a snap-action hinge so as to be able to readily maintain the hinge 48 and lid in the open position during pouring of the liquid from the container.

The base or body 46 is preferably injection-molded, along with the hinge 47 and lid 48, from a thermoplastic material compatible with the container contents.

The body 46 includes an annular mounting skirt or lower wall 56 (FIGS. 2–5). The skirt or wall 56 defines an opening 57 which is adapted to receive the container neck and which is adapted to completely encompass the container neck opening.

The wall 56 may have suitable attachment means (e.g., a conventional thread 55 (FIG. 4) or conventional snap-fit bead (not illustrated)) for engaging a suitable container cooperating means, such as a complementary thread or bead on the container neck, to secure the closure body 46 to the container. The closure body 46 and container could also be fixed together by induction melting, ultrasonic melting, gluing, or the like. The closure could also be formed as a unitary part of the container neck.

At the top of the annular mounting wall 56, the closure body 46 has a deck 58. The deck 58 extends radially inwardly over the opening 57 defined by the annular mounting wall 56. The deck 58 defines a smaller, dispensing orifice 60 at the top of the opening 57 defined by the mounting wall 56, and the orifice 60 would necessarily be at the top of the opening defined by the container neck when the closure 40 is mounted on the container.

Figure 3:
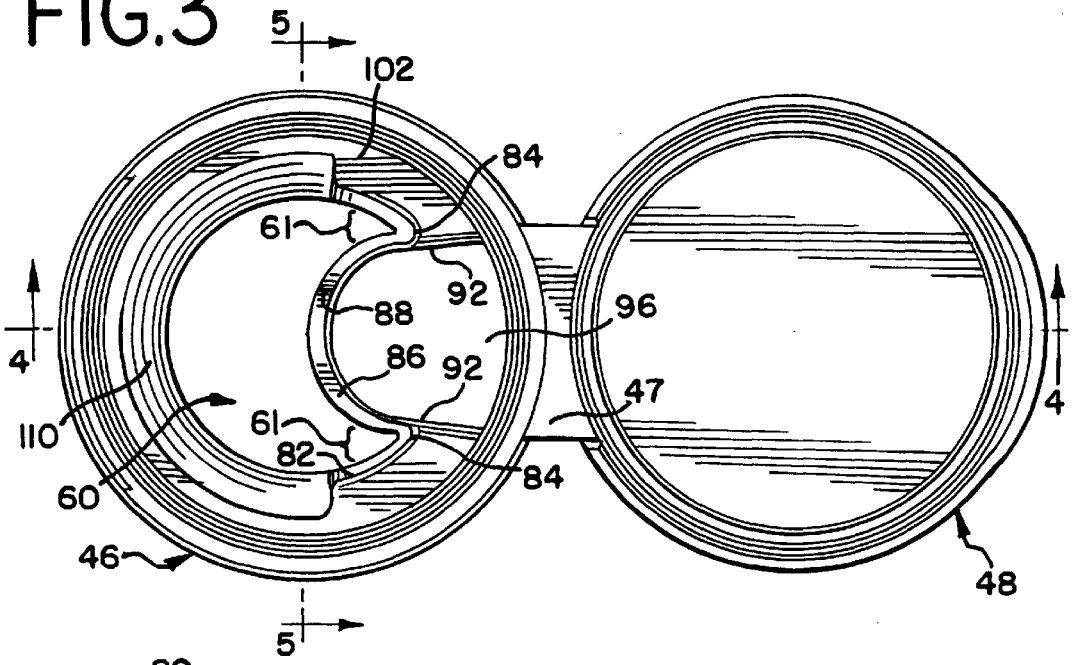
FIG. 3 is a top plan view of the dispensing structure shown in FIG. 1.

As illustrated in FIG. 3, the forward or front part of the dispensing orifice 60 has a circular arc configuration extending for more than a 180 degrees with a first radius. A rear portion of the dispensing orifice 60 is defined by a convex, smaller radius, circular arc. The dispensing orifice 60 thus appears to be crescent-shaped with two cusp regions 61.

The cusp regions 61 accommodate the inward flow of ambient air so as to eliminate or minimize "glugging" when liquid is poured from the tilted container through the orifice 60 in the closure 40. The air can enter the container through the cusp regions 61 even when most of the dispensing orifice 60 is completely filled with a flowing discharge stream. The air equalizes the pressure within the container and prevents a pressure reduction within the container which would inhibit the free, steady flow of liquid through the dispensing orifice 60.

Preferably, an annular, V-shaped seal 62 projects from the lower surface of the deck 58 and is received against the upper edge of the container neck adjacent the container neck opening so as to provide a leak-tight seal between the closure body 46 and the container neck. Of course, other types of closure body/container seals may be employed.

The container and closure 40 may be normally stored in the upright orientation wherein the closure 40 is at the top of the container. The closure lid 48 would typically be closed when liquid is not being poured from the container.

The body 46 includes an outer collar 70. The collar 70 includes a rear portion from which the hinge 47 extends. The lid 48 includes an inner seal ring 72 (FIG. 4) which is adapted to sealingly engage the collar 70 when the lid 48 is closed.

The body 46 also includes an inner spout 80. The inner spout 80 is smaller than the outer collar 70. The outer collar 70 is spaced outwardly of, and extends continuously around, the inner spout 80 and the opening 60.

The inner spout 80 has a crescent-shaped transverse cross section at its base corresponding with the crescent-shaped opening 60 of the closure body 46. The spout 80 may be characterized as having a first wall 82 which extends only partially around the opening 60 between two lateral margins 84. Each lateral margin 84 is a vertical edge of the first wall 82 and defines the point of one of the cusp regions 61 of the opening 60.

The inner spout 80 may also be characterized as having a retention wall 86 adjacent the opening 60. The retention wall 86 extends between the two lateral margins 84 of the spout first wall 82.

The retention wall 86 defines a notch 88. In the preferred embodiment, the notch 88 is open upwardly. However, the notch 88 could be bridged over by an upper part of the retention wall 86 (not illustrated). The term "notch" as used herein is intended to define an aperture through the retention wall 86 whether or not such an aperture is open upwardly at the top of the retention wall 86.

The bottom of the notch 88 is preferably located above the transverse deck 58.

The closure 40 has a reservoir which is defined by (i) the retention wall 86, (ii) the outer collar 70, (iii) two, spaced-apart sidewalls 92 (FIGS. 3 and 4), and (iv) a recessed bottom or floor 96 that is defined by the top surface of the deck 58. While the notch 88 may extend downwardly to the floor 96, a preferred feature of the invention is the spacing of the floor 96 below the bottom of the notch 88 in the retention wall 86. Further, in the preferred embodiment, the notch 88 is located between the recessed floor 96 and the orifice 60 of the body opening 57.

Figure 4:
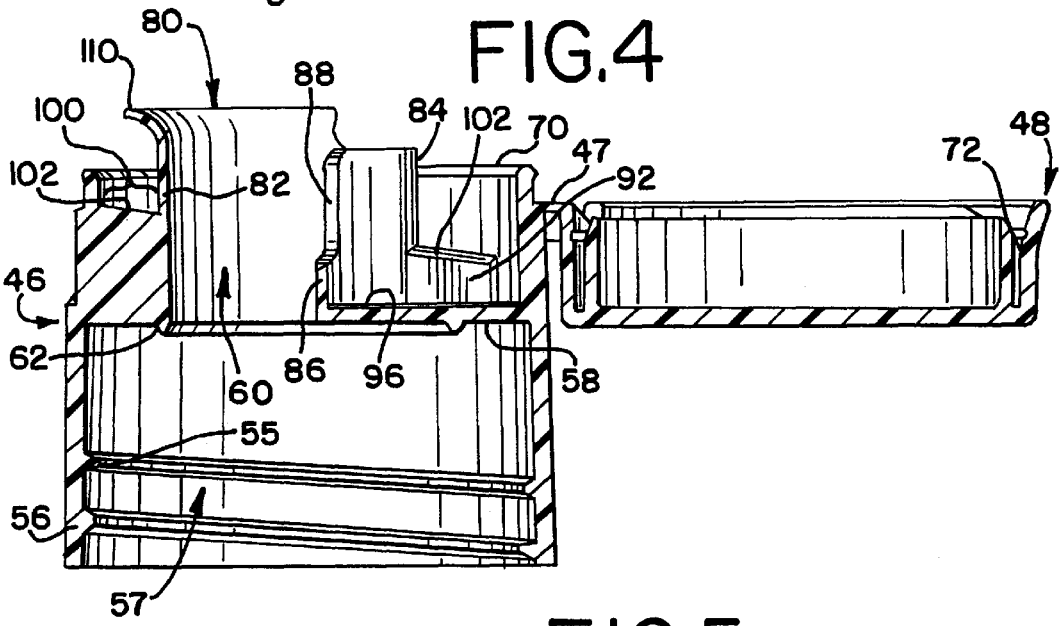
FIG. 4 is a cross-sectional view taken generally along the plane 4—4 in FIG. 3.

A drain-back trough 100 (FIG. 4) is defined between the outer collar 70 and the inner spout 80. The trough 100 has a bottom or a floor 102 (FIGS. 1, 3, and 4). The trough 100 has two open ends, one at each side of the reservoir adjacent the vertical reservoir sidewall 92. The trough bottom or floor 102 has a high point at the front of the closure (FIG. 4) and has two, spaced-apart low points which are each located at the sidewalls 92 adjacent the reservoir floor 96, but at an elevation higher than the elevation of the reservoir floor 96. As is shown in FIG. 4, each low point of the trough floor 102 occurs at the intersection of three surfaces: (1) the trough floor 102, (2) the reservoir vertical sidewall 92, and (3) the outer collar 70.

Figure 5:
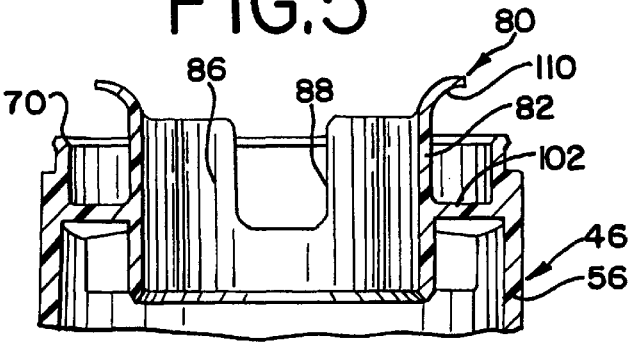
FIG. 5 is a cross-sectional view taken generally along the plane 5—5 in FIG. 3.

Preferably, the first wall 82 of the spout 80 includes a partially cylindrical lower portion, and the spout 80 includes a pour lip 110 which flares outwardly above at least part of the lower cylindrical portion of the inner spout first wall 82 (FIGS. 4 and 5).

Preferably, the inner spout 80 projects above the outer collar 70 (FIG. 4). Also, the bottom of the notch 88 in the retention wall 86 is preferably higher than the reservoir floor 96, but lower than the minimum height of the reservoir sidewalls 92 where the sidewalls 92 intersect the outer collar 70. Thus, liquid can accumulate in the reservoir when the closure is in the vertical orientation (as illustrated in FIG. 4), but if the height of the accumulated liquid reaches the bottom of the notch 88, then the liquid will flow through the notch 88 before the height of the accumulated liquid can exceed the height of the sidewalls 92.

In order to use the closure 40, the lid 48 is opened (to the position illustrated in FIGS. 1–5). Then the container, with the closure 40 mounted thereon, is tilted forwardly and downwardly. Liquid flows out of the container through the dispensing orifice 60, along the inner spout 80, and off of the distal end of the inner spout flared portion 110

When the container is returned to the normal upright orientation, liquid may drip over, or flow down, the exterior, outwardly facing surface of the spout 80. Such dripping liquid will be received in the trough 100 between the inner spout 80 and outer collar 70. The liquid in the trough will flow down along the bottom or floor 102 of the trough 100 toward either side of the reservoir. The liquid will then drop over sidewalls 92 into the reservoir. If the quantity of liquid in the reservoir fills the reservoir to the bottom of the notch 88, any more liquid draining into the reservoir will cause an equal quantity of liquid in the reservoir to overflow through the retention wall notch 88, through the dispensing orifice 60, and back into the container. Some or all of a pool of liquid remaining in the reservoir below the notch 88 will be discharged from the reservoir when the container and closure are subsequently tilted to pour more liquid. Of course, if the notch 88 is modified to extend downwardly to the reservoir floor 96, then drain-back liquid would immediately flow off of the floor 96, through the notch, and into the container.

Because there is no drain-back aperture in the reservoir floor 96 behind the inner spout 80, some or all of the region below the floor 96 need not be occupied by the opening in the container neck. The container neck may have a small opening or a forwardly located opening that communicates only with the closure body opening 60. The region below the closure body recessed floor 96 may be occupied by solid parts of the container, such as a thick portion of the container neck. Indeed, the lower part of the closure skirt and the container neck could each have a non-cylindrical configuration with an indentation under the recessed floor 96.

It will be readily observed from the foregoing detailed description of the invention and from the illustrations thereof that numerous other variations and modifications may be effected without departing from the true spirit and scope of the novel concepts or principles of this invention.

What is claimed is:

1. A drip-free dispensing structure comprising:

a body for extending from a container around an opening, said body having (a) an inner spout defining a notch;

(b) an outer collar spaced outwardly of, and extending continuously around, said inner spout and opening;

(c) a recessed floor extending between part of said inner spout and outer collar;

(d) an upwardly open notch defined in said inner spout and located between said opening and said recessed floor, said recessed floor intersecting said inner spout below the bottom of said notch; and (e) a drain-back trough bottom between said outer collar and said inner spout, said trough bottom having a high point and having two, spaced-apart, low points which are each located adjacent, but at a higher elevation than, said recessed floor.

2. A drip-free dispensing structure comprising:

a body for extending from a container around an opening, said body having (a) an inner spout;

(b) an outer collar spaced outwardly of, and extending continuously around, said inner spout and opening;

(c) a recessed floor extending between part of said inner spout and outer collar;

(d) a notch defined in said inner spout and located between said opening and said recessed floor; and (e) a drain-back trough bottom between said outer collar and said inner spout, said trough bottom having a high point and having two, spaced-apart, low points which are each located adjacent, but at a higher elevation than, said recessed floor, the elevation of said notch above said recessed floor being less than the elevation of either of said trough bottom low points above said recessed floor.

3. A drip-free dispensing structure comprising:

a body for extending from a container around a crescent-shaped opening, said body having (a) an inner spout projecting above said opening and having a height, at least a portion of the height of said inner spout having a crescent-shaped transverse cross section, said inner spout having (i) a first wall extending partially around said opening between two lateral margins, and (ii) a retention wall adjacent said opening and extending between said two lateral margins of said spout first wall, said retention wall defining an upwardly open notch;

(b) an outer collar spaced outwardly of, and extending continuously around, said inner spout and opening;

(c) a reservoir defined by (i) said retention wall, (ii) said outer collar, (iii) two, spaced-apart sidewalls each extending from one of said lateral margins to said outer collar, and (iv) a floor that is spaced below the bottom of said notch; and (d) a drain-back trough between said outer collar and said inner spout, said trough having an end adjacent each said lateral margin, said trough having a bottom with a high point and having two, spaced-apart, low points which are each located adjacent, but at a higher elevation than, said reservoir floor.

* * * * *